United States Patent [19]

Wolfe

[11] 4,270,227

[45] Jun. 2, 1981

[54] ARTICLES INCORPORATING AIR VENTS

[75] Inventor: Henry S. Wolfe, Harbor Bluff Largo, Fla.

[73] Assignee: American Clearwater Corp., Paterson, N.J.

[21] Appl. No.: 955,900

[22] Filed: Oct. 30, 1978

[51] Int. Cl.[3] ..... A41D 3/04; A43B 7/06

[52] U.S. Cl. ..... 2/87; 2/89; 2/DIG. 1; 36/3 A

[58] Field of Search ..... 2/87, 88, 89, 94, DIG. 1; 36/3 A

[56] References Cited

U.S. PATENT DOCUMENTS

| | | | |
|---|---|---|---|
| 1,529,981 | 3/1925 | Biton | 2/87 X |
| 2,181,175 | 11/1935 | Cohen | 2/87 |
| 2,190,802 | 2/1940 | Powell | 36/3 A |
| 2,400,627 | 5/1946 | Chavannes | 2/87 |

FOREIGN PATENT DOCUMENTS

| | | | |
|---|---|---|---|
| 657775 | 3/1938 | Fed. Rep. of Germany | 2/87 |
| 517370 | 2/1955 | Italy | 36/3 A |

*Primary Examiner*—H. Hampton Hunter

*Attorney, Agent, or Firm*—Hubbell, Cohen, Stiefel & Gross

[57] ABSTRACT

Air vent particularly suited for incorporation in rainwear comprising a base portion having a hole therein; and an elongate member secured to the base portion, the elongate member having a passage therethrough in communication with the hole, at least a portion of the elongate member being substantially perpendicular to the axis of the hole. Raincoats and other articles incorporating the air vent are also disclosed.

18 Claims, 5 Drawing Figures

FIG. 2
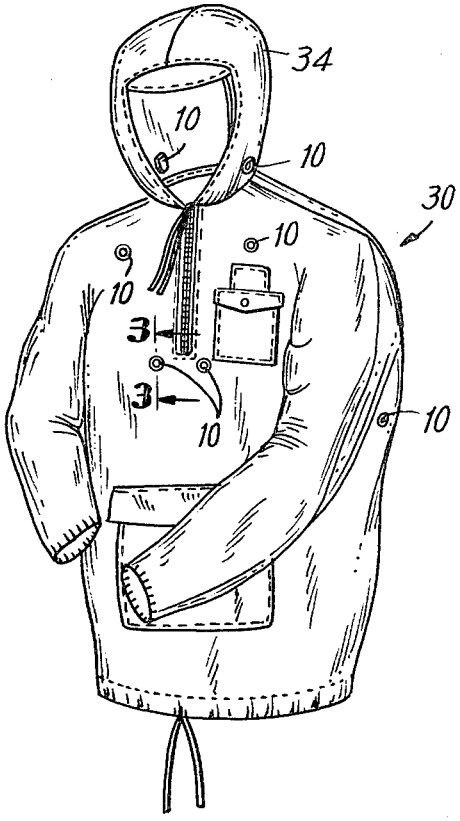
FIG. 1
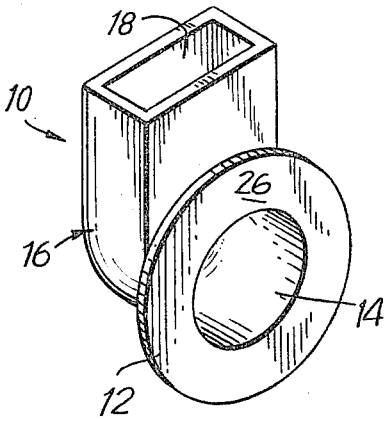
FIG. 3
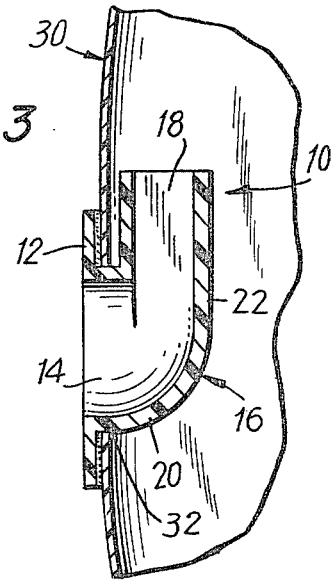
FIG. 4
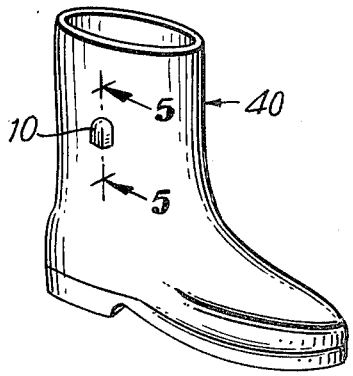
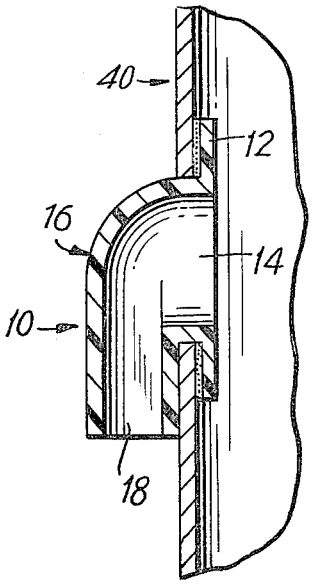
FIG. 5

ARTICLES INCORPORATING AIR VENTS

BACKGROUND OF THE INVENTION

1. Field of the Invention

This invention pertains to air vents and more particularly to air vents which restrict the entry of liquid therethrough.

2. Statement of the Prior Art

Current rainwear generally has minimal air circulation due primarily to the necessity of coating the rainwear with materials as polyvinyl chloride, polyurethane, etc. which keep out air as well as water.

Recently, so called "breathing" fabrics intended for incorporation in rainwear have been introduced. However, it is apparent that these fabrics are not truely waterproof but merely water repellent since it is well known that any fabric that is sufficiently porous to permit the entry of air will also permit the entry of water provided the pressure of the water striking the fabric is sufficient.

Another proffered solution has been to provide holes or eyelets under the arm where entry of water is unlikely. However, since the arm generally lies against the body, these holes are often closed thereby defeating their purpose. Another suggested solution has been to provide a plurality of holes across the back of the raincoat and thereafter sew or otherwise secure a yoke, cape, flap or the like over the holes. In addition to the added manufacturing expense occasioned by this technique, it will be apparent that flap must overlie the holes and, therefore, restricts the entry of air therethrough.

SUMMARY OF THE INVENTION

According to the present invention, I have developed an air vent suitable for incorporation in rainwear and the like which permits the unrestricted flow of air through the article yet inhibits the entry of water. In its preferred form, the air vent includes a substantially planar preferably circular base having a hole in the center thereof and an elongate member having a passage therethrough. The elongate member is secured to the base with the passage in communication with the hole in the base. In addition, the elongate member includes a portion substantially perpendicular to the axis of the hole in the base. Preferably, this is accomplished by employing an L-shaped elongate member, the short leg of the elongate member extending upwardly from the base and the longer leg extending perpendicularly thereto. While the air vent may be constructed in a variety of different ways, and from a variety of different materials, preferably it is injection molded from a suitable plastic as, for example, polyvinyl chloride.

The air vent may be incorporated in raincoats, other articles of rainwear such as boots, as well as in tents or the like. In the case of raincoats, holes will be cut in the raincoat at the various locations where air vents are desired. An air vent is then seated in each such hole that the base seats on the exterior of the raincoat and the elongate member extends inside the coat. The air vent is then rotated until the portion of the elongate member perpendicular to the hole in the base is oriented to extend upwardly when the raincoat is in use. For example, if the air vent is disposed on the torso of the coat, the perpendicular portion should be oriented toward the neck of the coat. The base is then secured to the raincoat as by heat sealing.

It will be apparent that when the raincoat is in use, the wearer will receive the benefit of increased air circulation through the air vents. The user will nevertheless remain dry thanks to the effect of gravity in preventing the flow of water up the passage in the elongate member.

When the air vents are secured to raincoats or other articles of clothing, the color of the base will preferably be matched to the article of clothing to minimize any detrimental esthetic effect occasioned by incorporation of the air vents. However, it will be apparent that the air vents may be incorporated in the raincoat by securing the bottom of the base to the interior of the raincoat rather than the exterior, in which case the entire air vent will be out of view. This is not preferred, however, as it is found that the joint between the air vent and the raincoat is not quite as strong when this technique is used and it also results in a greater portion of the air vent being inside the raincoat which may, under certain circumstances, prove uncomfortable. When the air vent is incorporated in a close-fitting article of clothing, such as a boot, it is not desirable to have the air vent extend into the boot as this may cause discomfort, difficulty in the wearer's inserting and removing his foot, and accidental snagging leading to possible damage. Accordingly, in such cases it is preferable to dispose the elongate member outside the boot by securing the upper surface of the base to the interior of the boot such that the elongate member extends out through the hole in the boot and beyond. When this is done, it will be apparent that the air vent must be oriented such that the portion of the elongate member perpendicular to the hole in the base extends downwardly when the article of clothing is in use.

These as well as other features and advantages of the air vent according to the present invention will be more fully apparent from the following detailed description and annexed drawing of the preferred embodiment thereof.

BRIEF DESCRIPTION OF THE DRAWING

In the drawing:

FIG. 1 is a perspective view of the preferred air vent of the invention;

FIG. 2 is a perspective view of a raincoat incorporating the preferred air vent according to the present invention;

FIG. 3 is a sectional view taken substantially along the lines 3—3 in FIG. 2;

FIG. 4 is a perspective view of a boot incorporating the preferred air vent;

FIG. 5 is a sectional view taken substantially along the lines 5—5 in FIG. 4;

DETAILED DESCRIPTION OF THE PREFERRED EMBODIMENT

Figure 6:
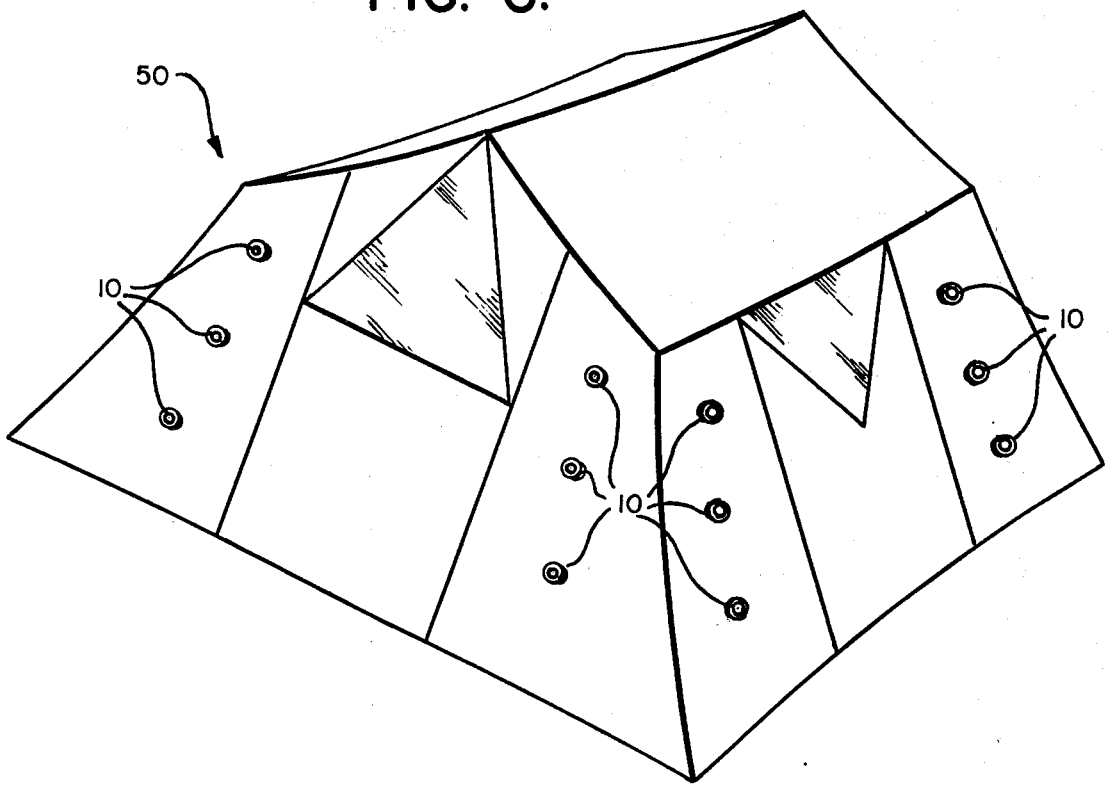
FIG. 6 is a perspective view of a tent incorporating the preferred air vent in accordance with the present invention.

Referring now to the drawings and initially to FIGS. 1 and 3 thereof, the preferred air vent 10 in accordance with the present invention is illustrated. As shown, air vent 10 comprises a base portion 12 having a hole 14 therein and an elongate member 16 defining a passage 18, the elongate member 16 being secured to the base 12 such that the passage 18 communicates with the hole 14. For reasons that will be more fully apparent hereinafter, the elongate member 16 includes a portion oriented with respect to the base 12 such that a section of the passage 18 is substantially perpendicular to the axis of the hole 14. While this may be achieved by making the member 16 in a variety of different shapes, as presently preferred and shown, the member 16 is substantially L-shaped. The short leg 20 of the member 16 is secured to the base 12 and the long leg 22 is secured to one end of the leg 20 and, as required, extends substantially perpendicular to the axis of hole 14.

The air vent 10 may be constructed in a variety of different ways and from a variety of different materials, provided the elongate member 16 comprises a water repellent, and preferably a waterproof material. Most desirably, the air vent 10 will be injection molded from a suitable plastic as, for example, polyvinyl chloride. However, those skilled in the art will appreciate that other materials, both hard and soft, may be employed. Such persons will also recognize that the base 12 and the elongate member 16 may be separately formed and joined together by, for example, heat sealing, suitable adhesives, etc. As presently preferred and shown, the base 12 is circular and substantially planar and passage 18 is of rectangular cross-section. Most preferably, the diameter of the base is about one and five-eighths of an inch, the length of the leg 20 is about three-quarters of an inch, the length of the leg 22 is about two and one-eighth of an inch, the diameter of hole 14 is about seven-eighths inches of an inch and the passage 18 is about one inch by three-quarters of an inch. However, these features are not mandatory and the actual shape and dimensions may be varied for other applications to suit available space, air intake requirements, etc. Thus, for example, the base 12 may be other than circular and may be of increased thickness. Likeness, the cross-section of the passage 18 may be circular, ovalshaped, etc.

The air vents 10 in accordance with the present invention are suitable for use in a variety of different applications, some of which will be discussed herein. However, they are particularly suited for incorporation in foul weather gear such as, for example, raincoats. Thus, referring to FIGS. 2 and 3, a conventional raincoat 30 having a plurality of air vents 10 incorporated therein is shown. To incorporate the air vents 10 in the raincoat 30, the raincoat is provided with holes 32 at the locations where air vents 10 are desired. While the size of the holes 32 may vary, they are preferably of substantially the same diameter as the holes 14 and in any event must be less than the diameter of the base portions 12.

To secure an air vent 10 to the raincoat 30, the air vent is preferably disposed in the hole 32 such that the base portion 12 lies on the outside of the raincoat and the elongate member 16 is on the inside. The air vent 10 is then rotated until the leg 22 of the elongate member 16 is oriented to extend upwardly when the wearer of the raincoat is standing upright. The base portion 12 is then fixedly secured to the raincoat 30 by securing its annular upper surface to the exterior of the coat 30 as by heat sealing, a suitable adhesive, etc. Care should be taken to insure that the resulting seal between the base 12 and the raincoat 30 is sufficient to prevent the leakage of water therethrough. It will be apparent that when the air vents 10 are secured to raincoat 30 in the manner described above, the holes 32 must be wide enough to receive the legs 20 of elongate members 16.

Once the air vents 10 are secured in place, the raincoat 30 is ready for use. When in use, air from outside the raincoat 30 may flow through the passages 18 to the wearer who will thereby receive increased ventilation as compared with prior art raincoats. In addition, because the legs 22 of the elongate member 16 are vertically oriented, the flow of water upwardly through the passages 18 will be restricted by gravity and the wearer will thereby remain dry. It will thus be apparent that the legs 22 of the elongate member 16 should be sufficiently long to prevent the possibility of water from the outside running through the passage 18 and inside the coat. For this purpose, I have found it desirable to make the legs 22 about two and one-eighth inches long, although the actual length may vary depending on the application. It will also be apparent that the possibility of water leaking into the raincoat through the passages 18 will be substantially reduced by proper selection of the location of the air vents 10 in the raincoat 30. For example, since it can be expected that the arms of the user and hence of the raincoat will be moved up and down, it is preferred that no air vents be located on the arms since with the arms in the upward position, the legs 22 of the elongate member 16 would face downward and would facilitate the entry of water into the coat. Accordingly, it is preferred that the location of the air vents 10 be restricted to the torso of the raincoat. If the raincoat 30 includes a hood, such as the hood 34 illustrated in FIG. 2, it may be desirable to incorporate air vents 10 in the back of the hood.

When the air vents 10 are secured to the raincoat in the manner described above wherein the bases 12 seat on the exterior of the raincoat, for esthetic reasons the bases 12 will preferably be colored to match the color of the raincoat. If the air vents 10 are injection molded from plastic, colored plastic will preferably be used in which case the entire vent 10 will match the color of the raincoat. This, however, is simply a by-product of the injection molding process and, as indicated above, only the base portions 12 need be colored to achieve the desired esthetic effect. Furthermore, while the air vents 10 are preferably secured to the raincoats 30 with the base 12 seated on the exterior of the raincoat, this too is not necessary. Thus, the lower annular surface 26 (FIG. 1) of the base 12 could be secured to the interior of the raincoat. While this method of securing the air vents 10 to the raincoat 30 is not presently preferred, it will be apparent that if it is employed, the bases 12 will not be exposed to view from the exterior of the raincoat and, therefore, need not be colored in the event that it is desired to have the raincoat 30 present a monochromatic appearance. If the base 12 is secured to the interior of the raincoat, the surface 26 may be secured to the raincoat in any of the ways described above for securing the upper annular surface of the base 12 to the exterior of the raincoat. Again, care should be taken that the seal between the surface 26 and the interior of the raincoat is sufficient to prevent leakage of water between the surface 26 and the raincoat.

Referring now to FIGS. 4 and 5, a boot 40 having an air vent 10 disposed on the leg portion thereof is shown. As illustrated, the air vent 10 is secured to the boot 40 with the upper annular surface of the base 12 secured to the inside of the boot such that the elongate member 16 extends outside of the boot. It will be apparent that if the air vent 10 were secured to the boot in the same manner as the air vents 10 illustrated in FIG. 2 are secured to the raincoat 30, the elongate member 16 would extend inside the boot and would hamper the wearer's insertion and removal of his foot. In addition, insertion and removal of the wearer's foot could snag the elongate member 16 and dislodge the air vent 10 from the boot 40. Accordingly, when the air vent 10 is incorporated in a boot or other close fitting article of clothing, it is desirable that the air vent be secured to the article as shown in FIG. 4. Alternatively, the air vent 10 may be incorporated into the boot 40 by securing the lower surface 26 to the outside of the boot such that the elongate member 16 is also outside the boot.

Once again, the lower surface of the air vent 10 may be secured to the boot 40 in any of the ways described above for securing the air vents 10 to the raincoat 30. It will be apparent that when the elongate member 16 is disposed outside of the article of clothing, as is the case with the air vent 10 illustrated in FIG. 4, elongate member 16 must extend downwardly to avoid the entry of rain into the boot through the passage 18. Also, when the air vent 10 is incorporated in a boot, the air vent 10 should be disposed sufficiently above the sole to prevent entry of water into the boot through the passage 18 when the wearer steps in a puddle or the like. While only one air vent 10 is shown in connection with the boot 40 in FIG. 4, it will be apparent that one or more additional air vents 10 may be incorporated in the boot at other locations.

Figure 7:
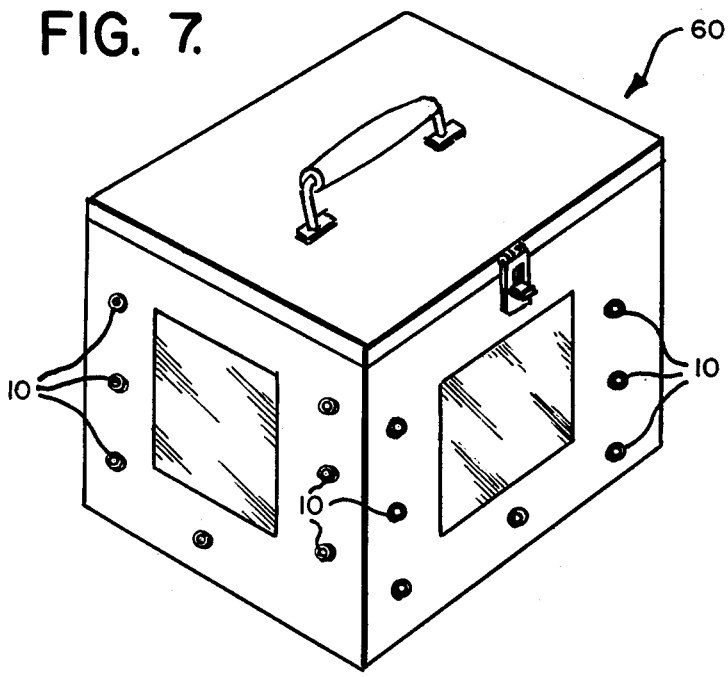
FIG. 7 is a perspective view of a carrying case for an animal incorporating the preferred air vent.

While thus far the air vent 10 has been described in connection with various articles of clothing, those skilled in the art will appreciate that many other applications exist where it is desired to prevent water from reaching an interior space while at the same time permitting air circulation into the space. For example, and as shown in FIG. 6, the air vent 10 may be effectively incorporated into a tent 50 to facilitate the entry of air while avoiding the entry of water. Similarly, and as shown in FIG. 7, air vents 10 in accordance with the present invention may be incorporated in a carrying case 60 for animals, etc.

Those skilled in the art will readily appreciate other applications.

Since these and other changes and modifications are intended to be within the scope of the present invention, the above description should be construed as illustrative and not in the limiting sense, the scope of the invention being defined by the following claims.

What is claimed is:

1. In an article defining a substantially closed space, said article having a substantially planar surface, the improvement comprising air vent means for preventing the entry of water into the space while accomplishing air circulation therethrough, said air vent means comprising:

(a) said planar portion of said article having an aperture therein;

(b) a base portion having a hole therein, said base portion being secured to the planar portion of said article about said aperture; and (c) an elongate, substantially L-shaped member having a passage extending therethrough in communication with said hole, said L-shaped member extending inside said article with one leg secured to the base portion and the other leg extending upwardly toward the top of said article.

2. The article according to claim 1, wherein said one leg of said L-shaped member is the shorter leg thereof.

3. The article according to claim 2, wherein the base portion is substantially planar.

4. The article according to claim 3, wherein the base portion is secured to the outside surface of said planar portion of said article, and the short leg of said L-shaped member extends through said aperture to the inside of said article.

5. The article according to claim 4, wherein said article is a raincoat.

6. The article according to claim 5, wherein said substantially planar portion of said raincoat is a portion of the torso of said raincoat.

7. The article according to claim 4, wherein said article is a tent.

8. The article according to claim 4, wherein said article is a boot.

9. The article according to claim 4, wherein said article is a carrying case for an animal.

10. In an article defining a substantially closed space, said article having a substantially planar surface, the improvement comprising air vent means for preventing the entry of water into the space while accomplishing air circulation therethrough, said air vent means comprising:

(a) said planar portion of said article having an aperture therein;

(b) a base portion having a hole therein, said base portion being secured to the planar portion of said article about said aperture; and (c) an elongate, substantially L-shaped member having a passage extending therethrough in communication with said hole, said L-shaped member extending outside the article with one leg secured to the base portion and the other leg extending downwardly toward the bottom of said article.

11. The article according to claim 10, wherein said one leg of said L-shaped member is the shorter leg thereof.

12. The article according to claim 11, wherein the base portion is substantially planar.

13. The article according to claim 12, wherein the base portion is secured to the inside surface of said planar portion of said article, and the short leg of said L-shaped member extends through said aperture to the outside of said article.

14. The article according to claim 13, wherein said article is a raincoat.

15. The article according to claim 14, wherein said substantially planar portion of said raincoat is a portion of the torso of said raincoat.

16. The article according to claim 13, wherein said article is a tent.

17. The article according to claim 13, wherein said article is a boot.

18. The article according to claim 13, wherein said article is a carrying case for an animal.

* * * * *